US007539425B2

(12) United States Patent
Knott et al.

(10) Patent No.: US 7,539,425 B2
(45) Date of Patent: May 26, 2009

(54) METHOD AND DEVICE FOR ADJUSTING TO A MINIMUM VALUE THE TONER SUPPLY TO A DEVELOPING STATION OF AN ELECTROGRAPHIC PRINTING UNIT OR COPYING UNIT

(75) Inventors: Joseph Knott, Tutzing (DE); André Gerd Schwarzkopf, Baldham (DE)

(73) Assignee: Oce Printing Systems GmbH, Poing (DE)

( * ) Notice: Subject to any disclaimer, the term of this patent is extended or adjusted under 35 U.S.C. 154(b) by 251 days.

(21) Appl. No.: 10/529,526

(22) PCT Filed: Oct. 7, 2003

(86) PCT No.: PCT/EP03/11088

§ 371 (c)(1),
(2), (4) Date: Aug. 22, 2006

(87) PCT Pub. No.: WO2004/034150

PCT Pub. Date: Apr. 22, 2004

(65) Prior Publication Data

US 2007/0036563 A1 Feb. 15, 2007

(30) Foreign Application Priority Data

Oct. 7, 2002 (DE) ..... 102 46 736

(51) Int. Cl.
*G03G 15/08* (2006.01)

(52) U.S. Cl. ..... 399/27; 399/49; 399/60

(58) Field of Classification Search ..... 399/27, 399/49, 60, 72, 74

See application file for complete search history.

(56) References Cited

U.S. PATENT DOCUMENTS

| | | | |
|---|---|---|---|
| 5,124,732 | A | 6/1992 | Manzer et al. |
| 5,387,965 | A | 2/1995 | Hasegawa et al. |
| 5,410,388 | A | 4/1995 | Pacer et al. |
| 5,767,888 | A | 6/1998 | Schleusener et al. |
| 6,075,954 | A | 6/2000 | Ogata et al. |
| 6,434,346 | B1 | 8/2002 | Knott et al. |
| 6,498,909 | B1 | 12/2002 | Reihl |

FOREIGN PATENT DOCUMENTS

| | | |
|---|---|---|
| DE | 38 07 121 | 9/1989 |
| EP | 0546953 | 6/1993 |
| EP | 0 683 954 | 6/1998 |
| EP | 0 881 548 | 12/1998 |
| WO | WO 99/36834 | 7/1999 |
| WO | WO 00/41038 | 7/2000 |

*Primary Examiner*—Hoang Ngo
(74) *Attorney, Agent, or Firm*—Schiff Hardin LLP

(57) ABSTRACT

In a method to adjust the toner supply to a minimum value in a developer station of an electrographic printing or copying device in which charge images are generated on an intermediate carrier, the charge images being inked with toner at the developer station, a toner concentration is measured in the developer station via a toner marking applied on the intermediate carrier and inked with toner at the developer station. A measurement signal is generated. Dependent on the measurement signal, a supply of the toner to the developer station is regulated. The supply of the toner to the developer station is increased independent of the measured toner concentration upon an under-run of a minimum value of the toner supply per unit time into the developer station so that the transfer of the toner from the developer station to the intermediate carrier is increased.

9 Claims, 2 Drawing Sheets

METHOD AND DEVICE FOR ADJUSTING TO A MINIMUM VALUE THE TONER SUPPLY TO A DEVELOPING STATION OF AN ELECTROGRAPHIC PRINTING UNIT OR COPYING UNIT

BACKGROUND

Electrographic printing or copying devices (collectively called printing devices in the following) are known, for example, from EP-B1-0 683 954. According to FIG. 1, such a printing device comprises a driven intermediate carrier ZT, for example, a photoconductor drum, on which are generated charge images of the images to be printed that are inked with toner, subsequently transfer printed onto a recording medium AT (for example paper) and fixed to this in a fixing station FX. For this, the printing device comprises, for example, the following components grouped around the intermediate carrier ZT:

a charge corotron L to charge the intermediate carrier ZT,
an illumination device (character generator) DK,
a developer station E,
a transfer printing station UDS,
a cleaning station R,
an erasure corotron LSC,
a discharge lamp EDL.

For example, the intermediate carrier ZT is charged to 500 V with the charge corotron L and then discharged to, for example, approximately 70 V with the illumination device DK to generate the charge images of the images to be printed. The charge images are subsequently inked with toner in a typical manner in the developer station E. However, the transfer of toner onto the intermediate carrier ZT only occurs when a sufficient voltage exists between the developer station E (for example a developer roller) and the discharged regions of the intermediate carrier ZT. If, for example, the developer roller exhibits a potential of 220 V and the charge images on the intermediate carrier ZT exhibit a potential of approximately 70 V, a field then results that pulls the toner from the developer station E to the intermediate carrier ZT. The toner images are subsequently transferred to the recording medium AT in the transfer printing station UDS. Finally the intermediate carrier ZT is cleaned of residual toner in the cleaning station R. The intermediate carrier ZT is prepared for a new printing event with the aid of the erasure corotron LSC and the discharge lamp EDL.

A developer made from carrier and toner (two-component developer) can be used in a known manner to develop the charge images on the intermediate carrier, whereby the fraction of toner is adjustable. In order to be able to check the fraction of toner, it is known (for example from WO 99/36834 A) to apply what is known as a toner marking that can be inked with toner onto the intermediate carrier. The inked toner marking can be scanned with a sensor that emits a signal dependent on the area coverage at the measurement location. This measurement signal serves to adjust the fraction of toner in the developer. The design of such a device and its operation can be learned from WO 99/36834 A, which is herewith included in the present disclosure. The toner supply into the developer station occurs in conveyer cycles that are implemented until the fraction of toner in the developer has reached the provided value.

A method for regulation of the toner supply in a developer station is known from U.S. Pat. No. 5,410,388 A. For this, a toner marking is generated and scanned on the intermediate carrier. When the scan of the toner marking results in that the signals generated in the scan of the front region and the scan of the rear region of the toner marking are different, and the signal associated with the front region is larger than the signal associated with the rear region, toner is conveyed into the developer station.

A method for control of the toner supply into a developer station is known from EP-A-0 546 953, in which the requirement for toner is determined and the scale of the supply of new toner per time unit is adjusted in the developer station dependent on this requirement. Differently designed dosing rollers are used for this. The requirement for toner is established either via counting of the image points of the images generated on the intermediate carrier or via measurement of the toner concentration in the developer station.

A method is known from U.S. Pat. No. 5,387,965 with which the toner supply to a developer station is controlled such that unwanted changes of the developer or of the intermediate carrier are taken into account. The toner concentration is thereby measured in the developer station by a sensor and compared with a predetermined reference value. Toner is conveyed into the developer station or not dependent on the comparison result.

A rule arrangement for a printing device is known from DE 38 07 121 A1, in which the developer station is controlled in order to achieve an optimal development of the charge images. The regulation occurs via a toner marking on the recording medium and its scanning. The toner supply to the developer station is regulated dependent on the scan result.

A further method for testing of the toner portion in the developer mixture with the aid of a toner marking can be learned from WO 00/41038 A.

Experience now shows that both the inking of the latent charge image on the intermediate carrier and the transfer printing of the print image from the intermediate carrier onto the recording medium are in particular impaired given printing operation with low toner throughput. Primarily responsible for this quality reduction is a deterioration of the developer that is created by mechanical friction forces given the mixing of carrier and toner. Two-component developer therefore requires a minimum degree of toner throughput in order to prevent the disadvantage cited above, since a too long mixing of the un-refreshed toner with the carrier in the developer station would lead to a damaging of the developer.

Given color printing, the problem of color drift additionally occurs in the case of the too-low print load, and therewith a too-low toner throughput.

SUMMARY

An object is to specify a method with which a minimum degree of toner throughput is ensured.

In a method or system to adjust the toner supply to a minimum value in a developer station of an electrographic printing or copying device in which charge images are generated on an intermediate carrier, the charge images being inked with toner at the developer station, a toner concentration is measured in the developer station via a toner marking applied on the intermediate carrier and inked with toner at the developer station. A measurement signal is generated. Dependent on the measurement signal, a supply of the toner to the developer station is regulated. The supply of the toner to the developer station is increased independent of the measured toner concentration upon an under-run of a minimum value of the toner supply per unit time into the developer station so that the transfer of the toner from the developer station to the intermediate carrier is increased.

DESCRIPTION OF THE PREFERRED EMBODIMENT

Figure 1:
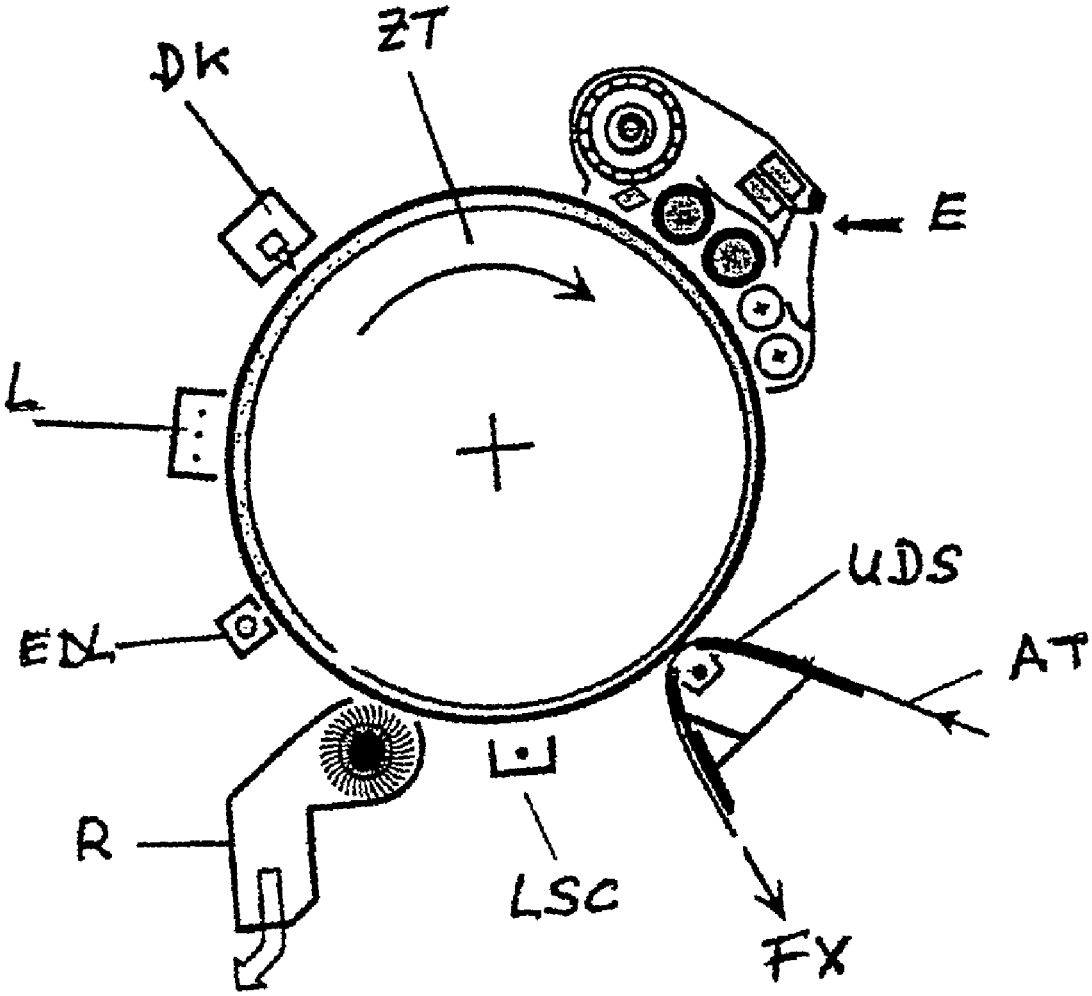
FIG. 1 illustrates a printing device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The advantage of the method is that a toner removal from the developer station are always used when the toner supply to the developer station per time unit is too low.

The establishment of the value of the toner supply per time unit can occur in that the number of the conveyances of toner (conveyer cycles) into the developer station per time unit are counted, and the minimum value is fixed at a predetermined number of conveyer cycles per time unit.

The means to increase the toner removal from the developer station can exist in that the transfer of toner to the intermediate carrier is increased, with the result that the toner supply into the developer station is also increased, and thus new toner arrives in the developer station. It is thus prevented that the problem mentioned above occurs. This can be achieved by using a control marking (larger in comparison with the toner marking) on the intermediate carrier and its inking via toner. When it is thus established that too few conveyer cycles are executed, and thus the toner supply is too low, the control marking is thus set until the number of the conveyor cycles is above the predetermined number. The toner marking can subsequently be written again alone on the intermediate carrier, and the printing device can be operated in a typical manner.

The control marking can contain the toner marking or be arranged separate from the toner marking.

Figure 2:
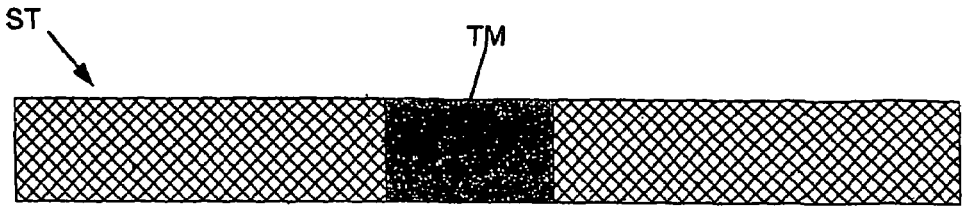
FIG. 2 is an example of the size of a toner marking and, in comparison to this, the size of a control marking.

It is to be learned from FIG. 2 that a control marking ST contains, for example, the toner marking TM, but can be selected significantly larger in comparison to the toner marking TM. While the toner marking TM takes up only a small region on the intermediate carrier ZT, the control marking ST can extend over the entire width of the intermediate carrier ZT. The discharge of the intermediate carrier ZT and thus its inking can be selected (shown dashed in FIG. 2) lower than its discharge at the location of the toner marking TM. However, the form of the control marking ST can be freely selected corresponding to the requirements of the respective printing operation. In FIG. 2 the toner marking is integrated into the control marking. The toner marking TM is furthermore necessary for measurement of the toner concentration in the manner specified above.

Figure 3:
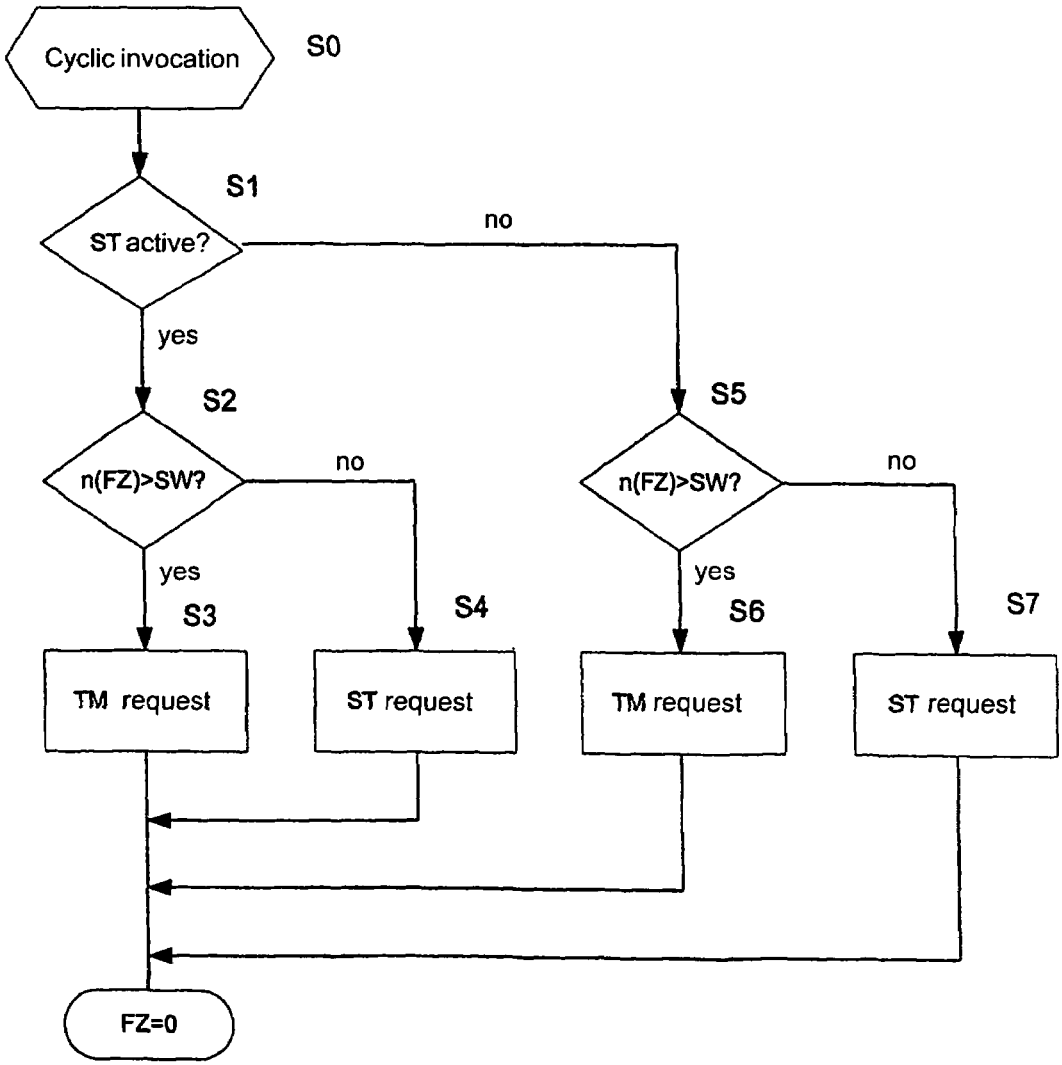
FIG. 3 is a flow diagram that shows the steps of the method.

The workflow of the method for adjustment of the toner supply, and thus for toner removal from the developer station, results from FIG. 3.

In a step S1, it can be checked whether the control marking ST is set (S1=active). When the control marking ST is set, in step S2 it is tested whether the number n of the conveyer cycles FZ of toner into the developer station (which number n is established via the toner marking regulation) exceeds a predetermined minimum value SW, thus n(FZ)>SW. If this is the case, in step S3 exclusively the toner marking TM is set and the normal operation is implemented; otherwise, in step S4 the control marking ST is requested. If, in step S1, it is established that the control marking ST is not active, in step S5 it is checked whether the number n of the conveyor cycles FZ exceeds the predetermined minimum value SW, thus whether n(FZ)>SW. If this is the case, in step S6 the toner marking TM alone is requested; otherwise, in step S7 the control marking ST is recalled. The implementation of this method can occur cyclically; for example, in a step S0, every 60 seconds it can be queried whether the control marking ST is set.

The minimum value of the toner supply per time unit has been established in the exemplary embodiment by the number n of the conveyor cycles FZ/time unit; for example, the minimum value can amount to SW=2 conveyor cycles/seconds. However, other means are also possible in order to ensure the toner supply to the developer station.

Another workflow of the method is likewise possible; it is, however, significant that a method is provided to ensure the toner renewal in the developer station given a too-low toner supply to the developer station.

The method can be integrated as software into an already present controller. Such a controller is, for example, known from WO-A-00/41038. The establishment of the conveyor cycles for toner can be integrated into a controller as it is described in WO-A-99/36834, which is herewith included in the disclosure.

Exemplary embodiments of the invention have been described. It is thereby clear that the average man skilled in the art can at any time specify modifications and developments that use the inventive concept. Furthermore, the invention can be realized both by means of electronic components (hardware) and via computer program elements (software or software modules). The invention may be realized from a combination of electronic hardware elements and software elements, for example. The invention accordingly also may include computer program products such as, for example, electronic data media (CD, DVD, diskettes, tape drives), or components that are distributed via computer networks (Internet) and/or loaded or stored on computers and in particular into buffers and/or run on computers.

We claim as our invention:

1. A method to adjust a toner supply to a minimum value in a developer station of an electrographic printing or copying device, in which charge images of images to be printed are generated on an intermediate carrier, the charge image being inked with toner at the developer station, comprising the steps of:

measuring toner concentration in the developer station via a toner marking applied on the intermediate carrier and inked with toner at the developer station, and generating a measurement signal;

dependent on the measurement signal, regulating a supply of the toner to the developer station;

increasing the supply of the toner to the developer station independent of the measured toner concentration upon an under-run of a minimum value of the toner supply per unit time into the developer station so that transfer of the toner from the developer station to the intermediate carrier is increased; and a control marking increased in comparison with the toner marking being loaded and inked with toner to increase the toner transfer from the developer station to the intermediate carrier.

2. A method according to claim 1 wherein the minimum value of the supply of toner to the developer station is established by a number of conveyer cycles per unit time.

3. A method according to claim 1 wherein the control marking comprises the toner marking.

4. A method according to claim 1 wherein the control marking is applied on the intermediate carrier until a number of conveyer cycles exceeds said minimum value.

5. A method according to claim 1 wherein the control marking is applied on the intermediate carrier until a number of conveyer cycles exceeds said minimum value.

6. A method according to claim 1 wherein it is checked at established times whether the control marking is set, and when this occurs a number of conveyer cycles per unit time is checked as to whether it exceeds a minimum value, and when this occurs, the toner marking is again generated on the intermediate carrier.

7. A method according to claim 6 wherein control markings are generated on the intermediate carrier when the number of the conveyer cycles does not exceed the minimum value.

8. A method according to claim 6 wherein the toner marking is generated when the control marking is not set and the number of the conveyer cycles is greater than the minimum value; otherwise the control marking is requested.

9. A system to adjust a toner supply to a minimum value in a developer station of an electrographic printing or copying device, comprising:

a generator to generate charge images of images to be printed on an intermediate carrier, and a developer station that inks the charge images with toner;

a measurement unit that measures a toner concentration in the developer station via a marking applied on the intermediate carrier and inked with toner at the developer station, and that generates a measurement signal;

a regulator that, dependent on said measurement signal, regulates a supply of the toner to the developer station, and which increases the supply of toner to the developer station, independent of the measured toner concentration, upon an under-run of a minimum value of the toner supply into the developer station per unit time so that the transfer of toner from the developer station to the intermediate carrier is increased; and said generator and developer station loading and inking with toner a control marking increased in comparison with the toner marking to increase the toner transfer from the developer station to the intermediate carrier.

* * * * *